United States Patent [19]

Wedertz

[11] Patent Number: 4,667,899

[45] Date of Patent: May 26, 1987

[54] DOUBLE SWING WING SELF-ERECTING MISSILE WING STRUCTURE

[75] Inventor: Larry D. Wedertz, Mira Loma, Calif.

[73] Assignee: General Dynamics, Pomona Division, Pomona, Calif.

[21] Appl. No.: 676,034

[22] Filed: Nov. 28, 1984

[51] Int. Cl.[4] ..... B64C 3/56; B64C 3/54

[52] U.S. Cl. ..... 244/49; 244/218; 244/3.24; 244/3.27; 244/3.28; 244/3.29

[58] Field of Search ..... 244/3.24, 3.27, 3.28, 244/3.29, 46, 49, 201, 218, 211, 203

[56] References Cited

U.S. PATENT DOCUMENTS

| | | | |
|---|---|---|---|
| 1,560,860 | 11/1925 | Ries | 244/218 |
| 2,365,577 | 8/1943 | Moore | 102/50 |
| 2,573,271 | 10/1951 | Perl | 244/49 |
| 2,961,196 | 4/1954 | Atkinson | 244/46 |
| 2,977,880 | 4/1961 | Kershner | 244/49 |
| 3,053,484 | 7/1961 | Alford, Jr. et al. | 244/43 |
| 3,063,375 | 11/1962 | Hawley et al. | 244/49 |
| 3,087,692 | 1/1963 | Lowry | 244/46 |
| 3,127,838 | 4/1964 | Moratti et al. | 244/3.28 |
| 3,304,030 | 9/1965 | Weimholt et al. | 244/3.28 |
| 3,633,846 | 1/1972 | Biggs, Jr. | 244/3.27 |
| 4,106,727 | 8/1978 | Ortell | 244/49 |
| 4,247,063 | 1/1981 | Jenkins | 244/91 |
| 4,299,146 | 6/1980 | Mattson | 244/3.27 |
| 4,323,208 | 4/1982 | Ball | 244/3.28 |
| 4,334,657 | 6/1982 | Mattson | 244/3.28 |
| 4,471,923 | 9/1984 | Hoppner et al. | 244/49 |

*Primary Examiner*—Trygve M. Blix
*Assistant Examiner*—Rodney Corl
*Attorney, Agent, or Firm*—Neil F. Martin; Loyal M. Hanson; Edward B. Johnson

[57] ABSTRACT

A self-erecting wing structure for increased missile performance and maneuverability without significant sacrifice of payload space includes a wing pivotally attached to an air frame in a retracted position in which the wing is both rotated about its spanwise axis relative to an erected position and pivoted forward alongside the air frame. Rotational components enable passing air to swing the wing to the erected position when it is released from the retracted position during flight. A secondary wing surface is included that automatically deploys to increase wing area.

9 Claims, 8 Drawing Figures

DOUBLE SWING WING SELF-ERECTING MISSILE WING STRUCTURE

BACKGROUND OF THE INVENTION

This invention relates in general to erectable wing structures, and particularly pertains to a self-erecting wing structure suitable for use on a guided missile.

Improved missile performance and maneuverability is achieved through the use of wings on the missile. In some applications, such as a guided anti-armor rocket, it is important that the wings be stowed out of the way to enable the missile to be launched, and then automatically erected while the missile is in flight. It is important that this be accomplished without sacrificing precious payload space inside the missile and without impairing the seal a missile air frame provides against outside hazards such as water or RF signals. It is important that the wings be aerodynamically clean and provide ample lift.

Existing erectable wing structures, such as curved "wrap around" wings, are often deficient in these important respects so that it is desirable to have a new erectable wing structure.

SUMMARY OF THE INVENTION

This invention provides a self-erecting wing structure with the desired attributes.

An exemplary embodiment constructed according to the invention includes a wing that is pivotally attached to an air frame in a retracted position. The retracted position is one in which the wing is both rotated about its spanwise axis relative to an erected position and pivoted forward alongside the air frame. Rotational components are provided that enable passing air to swing the wing to the erected position when the wing is released from the retracted position during flight.

The illustrated embodiment includes a recess in the air frame in which to store the wing in the retracted position. The wing is shaped and dimensioned to conform to the shape of the air frame when stored in this position, and it includes a secondary wing surface within it that automatically deploys in flight to increase wing area.

Thus, this invention provides a self-erecting wing suitable for use on a missile to increase performance and maneuverability without sacrificing precious payload space.

Other features and many attendant advantages of the invention will become more fully apparent upon a reading of the detailed description in conjunction with the drawings wherein like numerals refer to like components throughout.

DETAILED DESCRIPTION

Figure 1:
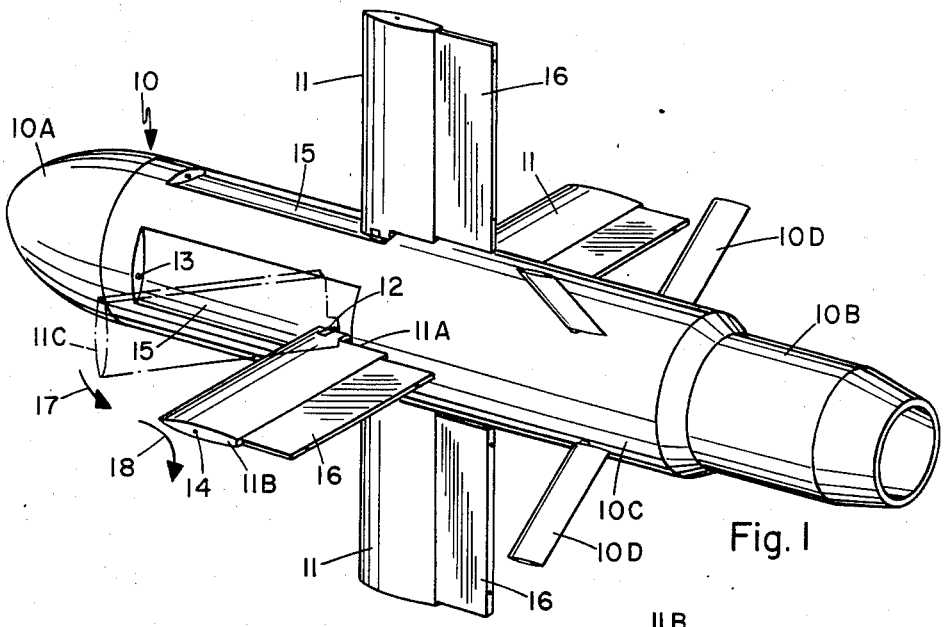
FIG. 1 is perspective view of a typical missile with the wings fully extended.

An exemplary embodiment of a self-erecting wing structure constructed in accordance with the invention is shown in place on a missile in FIG. 1. The missile air frame is referred to generally by reference numeral 10. It includes a nose portion 10A, a tail portion 10B, and a middle portion 10C. The illustrated missile includes steering vanes 10D to represent steering vanes of the type typically employed on missiles.

Missile 10 includes four self-erecting wing structures, each of which is designated with reference numeral 11 (FIG. 1). Each wing includes a root end 11A and a tip end 11B. These features are designated on one of the four wings in FIG. 1. Each wing also includes a spanwise axis extending between the root end and the tip end.

The wing structure includes attaching means, designated reference numeral 12 in FIG. 1, for pivotally attaching the wing to the missile air frame in an erected position such as that illustrated. These attaching means include rotational components that enable rotation of the wing about its spanwise axis substantially 90° and the simultaneous pivoting of the wing forward about an axis (a pivot axis) that is generally perpendicular to the spanwise axis, to a retracted position alongside the air frame. One of the four wings 11 in FIG. 1 is illustrated by phantom lines 11C rotated and partially pivoted to the retracted position.

The illustrated wing structure includes a retainer 13 for releasably engaging tip 11B of wing 11. This is accomplished in the illustrated embodiment by solenoid core 13B which will be discussed later with reference to FIG. 8. This core engages hole 14 in the tip end of the wing to releasably retain the wing in the retracted position.

The illustrated embodiment includes recess 15 in the air frame in which the wing is stored in the retracted position, there being a recess 15 corresponding to each wing 11. The wing is shaped and dimensioned so that when stored in a retracted position in the recess the wing conforms to the contour of the air frame. This limits any adverse effects on missile aerodynamics of the wing when it is stored in the retracted position. It also allows use of the self-erecting wing structure on missiles designed to be launched from a tube, since the retracted wings conform to the usual shape of the missile air frame.

Attaching means 12 of the illustrated embodiment includes means for causing the wing to pop out of the recess when retainer 13 is released. This is accomplished in the illustrated embodiment by dimensioning the rotational components so that wing 11 is elastically deformed slightly when snapped into the retracted position. The wing must be pressed into the recess, and when released it pops (springs) out. This feature will be discussed later with referece to FIG. 4.

Attaching means 12 includes means for enabling passing air to swing the wing to an erected position when it is released during flight. The rotational components serve this function, and erection is accomplished by simply releasing the wing from the retracted position. As the wing pops out of the recess, the rotational components enable passing air to pivot and rotate the wing (swing the wing) into the erected position. The wing swings outwardly as illustrated by arrow 17 in FIG. 1, pivoting about the pivot axis. At the same time it rotates about the spanwise axis as illustrated by arrow 18. Thus, it resumes the erected position in which the four wings 11 are illustrated in FIG. 1, and it locks into this position in a manner to be subsequently described with respect to FIGS. 3–5.

As wing 11 swings back into an erected position, secondary wing surface 16 automatically deploys to increase wing area.

Thus, the invention provides a self-erecting wing suitable for use on a missile to increase performance and maneuverability without sacrificing precious payload space. In the retracted position, the wing conforms to the contour of the air frame and enables launching of the missile by conventional means, a minimum amount of payload space being required for each recess and for the rotational components.

Figure 2:
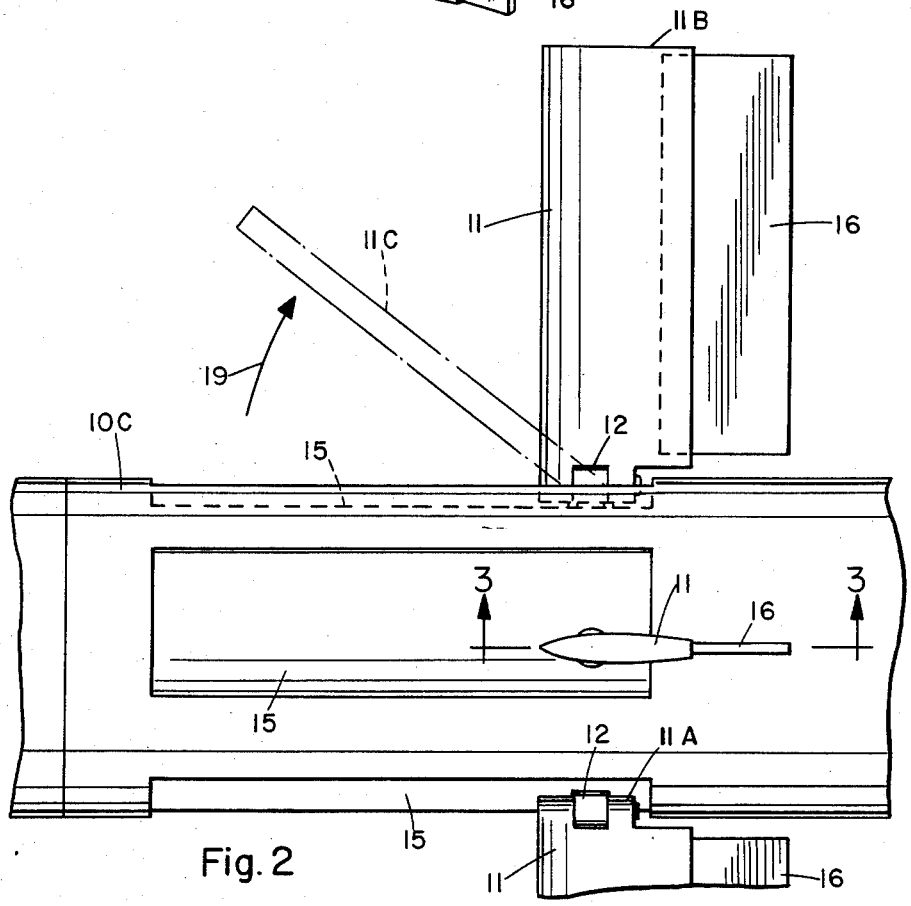
FIG. 2 is an enlarged side elevation view of the wing containing portion of the missile.

Further details of the wing structure are shown in FIG. 2. Center portion 10C of missile air frame 10 includes means defining a recess 15 corresponding to each wing 11. The air frame is shaped and dimensioned to serve this function and define a recess in the illustrated embodiment. Upon release of wing 11 from the retracted position, it pops out of the recess slightly, and passing air forces it back in the direction indicated by arrow 19 to the erected position. The wing is shown by phantom lines designated 11C in a partially erected position, and attaching means 12 designates the rotational components enabling self-erection under pressure of passing air.

Secondary wing surface 16 is illustrated fully deployed in FIG. 2. Wing 11 includes means for containing secondary wing surface 16 within it during storage of the wing in the retracted position, and means are included for automatically deploying the wing. Further details of these features are shown in FIG. 3.

Figure 3:
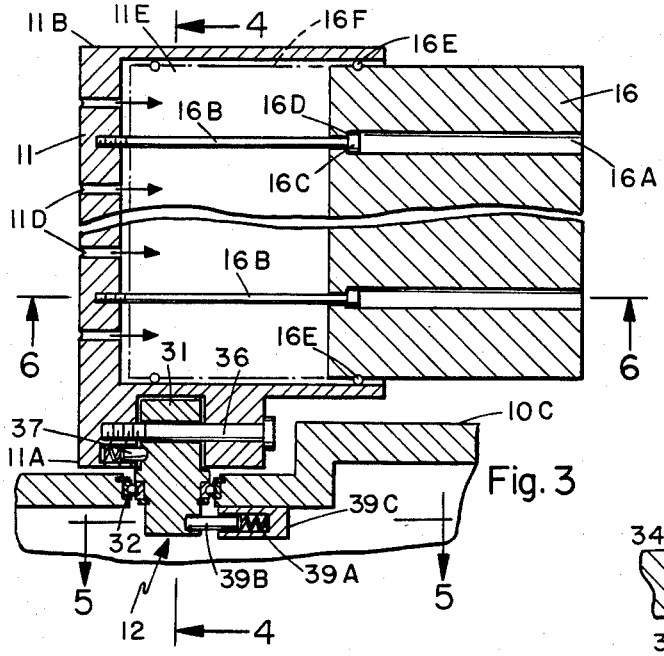
FIG. 3 is an enlarged section view taken on line 3—3 of FIG. 2.

As illustrated in FIG. 3, wing 11 includes air intake holes 11D and hollow interior 11E. The wing is suitably shaped and dimensioned with this hollow interior to serve the function of containing the secondary wing surface. This feature combines with guide holes 16A in the secondary wing surface, bolts 16B, and bearings 16E to enable storage of the wing surface within wing 11 when the wing is in the retracted position. These components also enable passing air entering through holes 11C (depicted in FIG. 3 by arrowheads) to automatically deploy the secondary wing surface as wing 11 self erects during the flight of the missile.

Bolts 16B extend through holes 16A and screw into the wing. These bolts serve to guide secondary wing surface 16 from a stored position, illustrated in phantom lines and designated reference numeral 16F, to the fully deployed position illustrated in FIG. 3. Suitable means are provided for preventing the secondary wing surface from deploying beyond the fully deployed position illustrated, such as bolt heads 16C abutting an inwardly-extending annular shoulder 16D within hole 16A.

Figure 6:
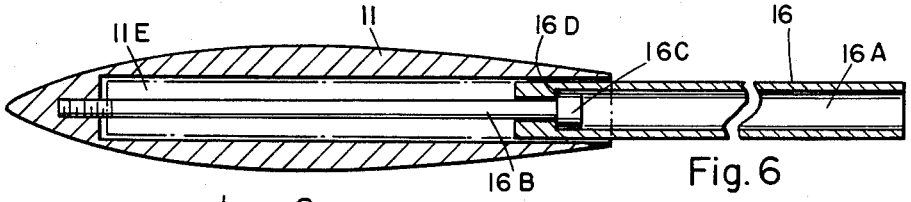
FIG. 6 is an enlarged sectional view taken on line 6—6 of FIG. 3.

Bearings 16E represent suitable bearing means, such as ball bearings, for reducing friction between secondary wing surface 16 and wing 11 to reduce the amount of air pressure required to deploy the secondary wing surface. As shown in FIG. 6, the secondary wing surface is stored within the hollow interior of wing 11 in the position indicated by phantom line 16F. When fully deployed, head 16C of bolt 16B abuts annular shoulder 16D within hole 16A.

Figure 4:
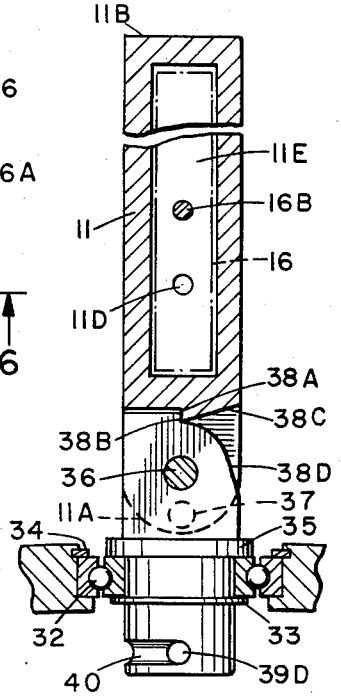
FIG. 4 is a further enlarged sectional view taken on line 4—4 of FIG. 3.
Figure 5:
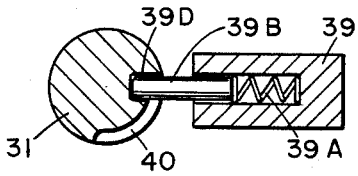
FIG. 5 is an enlarged sectional view taken on line 5—5 of FIG. 3.

FIGS. 3–5 illustrate features of the rotational components employed as part of attaching means 12. As shown in FIG. 3, trunnion 31 is rotatably mounted on center portion 10C of the missile air frame with suitable means such as bearing assembly 32. Snap ring 33 and crimp 34 combine with annular flange 35 to retain the trunnion and bearing assembly in place. These components serve to enable rotation of the trunnion (and a wing 11 thereto attached) about a spanwise axis of the wing.

Root end 11A of the wing is pivotally attached to the trunnion by suitable means such as pivot bolt 36 (FIG. 3). These components enable pivoting of the wing forward alongside the air frame about the pivot axis. Wing lock 37 (FIGS. 3 and 4), comprising suitable locking means such as a spring and pin engaging a hole in the trunnion, prevents the wing from pivoting after it has pivoted to the extended position.

Wing stop surfaces 38A and 38B (FIG. 4) serve to stop the wing from pivoting beyond the fully erected position, while wing stop surfaces 38C and 38D serve to stop the wing from pivoting fully into the retracted position. The wing must be elastically deformed slightly to be positioned and retained in (snapped into) the recess, and this springbiases the wing so that it will pop out of the recess when released from the retracted position.

Trunnion lock 39 (FIG. 5), comprising spring 39A and pin 39B, mounted on support structure 39C, engages hole 39D to prevent rotation of the trunnion once the wing has fully erected. This spring-pin-hole combination is similar to what might be used for wing lock 37.

Further details of the trunnion lock are shown in FIGS. 4 and 5. Trunnion 31 includes groove 40. Pin 39B is guided along this groove as trunnion 31 rotates to the erected position. When the trunnion has rotated to the erected position, pin 39B seats in hole 39D and prevents further rotation.

Figure 7:
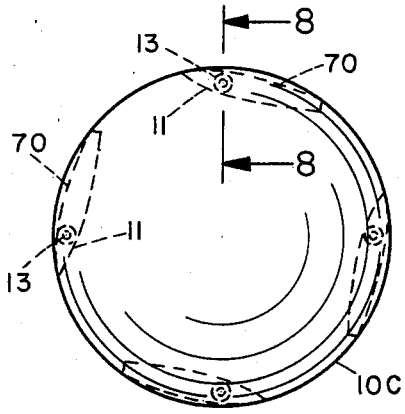
FIG. 7 is a front view of the missile showing the positions of the retracted wings.

The illustrated embodiment includes means for releasably retaining each wing 11 in a retracted position. FIG. 7 illustrates each of the four wings of the illustrated embodiment in a retracted position within a respective recess in the missile air frame. Each retainer mechanism is designated generally in FIG. 7 by reference numeral 13. Conforming wing surfaces 70 are illustrated in FIG. 7 to show that the wings are shaped and dimensioned so that the surfaces generally conform with he contour of the missile air frame.

Figure 8:
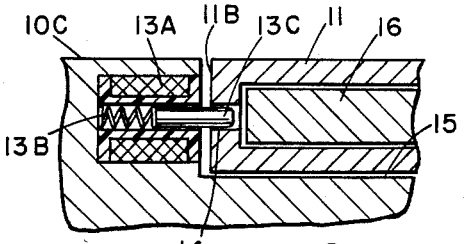
FIG. 8 is an enlarged sectional view taken on line 8—8 of FIG. 7.

In FIG. 8 the details of retainer 13 are shown. It comprises a solenoid 13A attached to the missile air frame adjacent the tip end of wing 11, a spring 13B, and a core 13C. The core seats in hole 14 when the wing is in the retracted position to retain the wing in place. By energizing the solenoid the core is withdrawn from hole 14 so that the wing can pop out of the recess for erection under pressure of passing air.

Thus, the invention provides means for enabling passing air to swing the wing to the erected position upon release of the wing from the retracted position during flight. It does this with little sacrifice of precious payload space within the missile.

As various changes may be made in the form, construction, and arrangement of the parts herein, without departing from the spirit and scope of the invention and without sacrificing any of its advantages, it is to be understood that all matter herein is to be interpreted as illustrative and not in any limiting sense.

What is claimed is:

1. An erectable wing structure, which comprises:

an air frame;

a wing having a root end, a tip end, and a spanwise axis extending therebetween, the wing being attached to the air frame in a retracted position in which the wing is both rotated from an erected position about the spanwise axis and pivoted forward alongside the air frame; said wing including means for storing a secondary wing surface within the wing while the wing is in the retracted position;

means for enabling passing air to swing the wing to the erected position upon release of the wing from the retracted position during flight including;

rotational components connecting said wing to said air frame; said components enabling the wing to simultaneously pivot and rotate from the retracted position to the erected position under pressure of passing air;

a secondary wing surface; and means for automatically deploying the secondary wing surface when the wing is released from the retracted position to thereby increase wing area.

2. The structure recited in claim 1 which includes means for locking the wing in the erected position.

3. The structure recited in claim 1 which includes means for causing the wing to pop out from the retracted position when the wing is released from the retracted position.

4. The structure recited in claim 1 wherein the air frame includes means defining a recess in the air frame in which the wing can be stored in the retracted position.

5. The structure recited in claim 1 which includes means for releasably retaining the wing in the retracted position.

6. The structure recited in claim 5 wherein the retaining means includes a retainer mechanism attached to the air frame in a position to engage the tip end of the wing when the wing is in the retracted position.

7. The structure recited in claim 6 wherein the retainer mechanism includes a solenoid.

8. The structure recited in claim 4 wherein the wing is shaped and dimensioned to conform to the shape of the air frame when the wing is within the recess.

9. The structure recited in claim 1 wherein the deploying means includes means for enabling passing air to cause the secondary wing surface to deploy.

* * * * *